United States Patent [19]

Nelson

[11] Patent Number: 4,583,956

[45] Date of Patent: Apr. 22, 1986

[54] RIGID AND TELESCOPING STRUT MEMBERS CONNECTED BY FLEXIBLE TENDONS

[76] Inventor: William A. Nelson, 52 High St., Middleburg, Vt. 05753

[21] Appl. No.: 667,748

[22] Filed: Nov. 2, 1984

[51] Int. Cl.[4] ..... A63H 33/10

[52] U.S. Cl. ..... 446/119; 446/122

[58] Field of Search ..... 446/119, 85, 104, 122; 403/217, 218, 219

[56] References Cited

U.S. PATENT DOCUMENTS

| | | | |
|---|---|---|---|
| 2,719,384 | 10/1955 | Eames | 446/119 |
| 2,765,580 | 10/1956 | Herrschaft | 446/119 |
| 3,222,072 | 12/1965 | Dreyer | 446/119 |
| 3,422,565 | 1/1969 | Kentfield et al. | 446/119 |
| 3,694,954 | 10/1972 | Brumlik | 446/119 |
| 3,866,366 | 2/1975 | Fuller | 52/81 |
| 4,148,520 | 4/1979 | Miller | 52/648 |
| 4,398,888 | 8/1983 | Darling et al. | 446/119 |
| 4,449,348 | 5/1984 | Jacobs | 52/648 |

FOREIGN PATENT DOCUMENTS

| | | | |
|---|---|---|---|
| 1179696 | 5/1959 | France | 446/119 |
| 134655 | 11/1929 | Switzerland | 446/119 |
| 592669 | 9/1947 | United Kingdom | 446/119 |

*Primary Examiner*—Robert A. Hafer
*Assistant Examiner*—Daniel Nolan

[57] ABSTRACT

A construction kit consisting of rigid or telescoping elongate strut members which may be attached together by flexible tendons to form a variety of designs and model structures. The invention places no limits on the number of struts which can be attached at one vertex or their relative angles, and the length of each strut may be varied within broad limits. Furthermore, the end of one strut may be attached not only to the end of another, but to any point along its length. Accordingly, an almost unlimited variety of constructions is possible.

4 Claims, 7 Drawing Figures

FIG. 3.
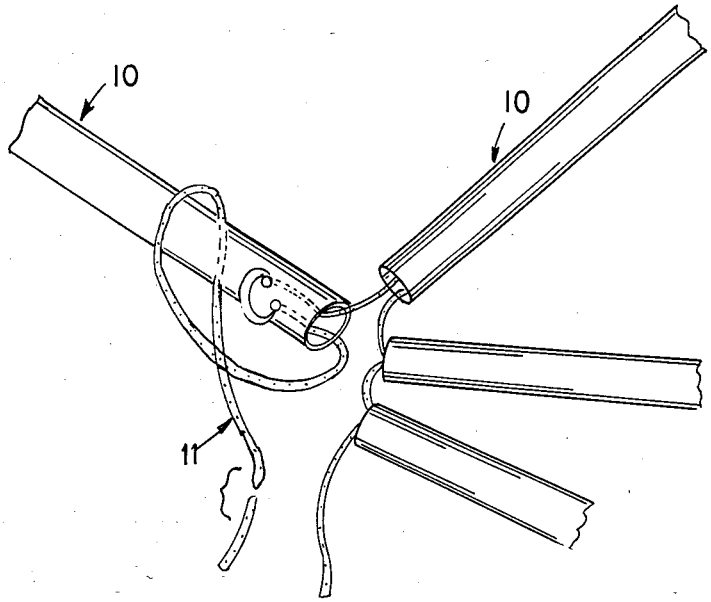
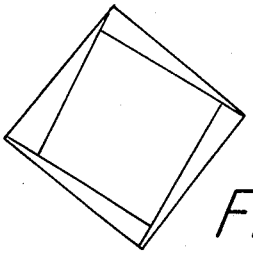
FIG 4

RIGID AND TELESCOPING STRUT MEMBERS CONNECTED BY FLEXIBLE TENDONS

BACKGROUND OF THE INVENTION

The present invention relates to a construction kit comprising elongate structural members designed to be connected to each other by flexible tendons, permitting the construction of a wide variety of two or three dimensional designs and structures. Well-known in the art are construction kits having wooden strut components with the connectors therefor being in the form of multi-apertured wooden discs or spheres with construction restricted to definite angular relationships between adjacent struts. See e.g. the U.S. Pat. To Barlow, U.S. Pat. No. 4,271,628. Further, the number of struts joined by the connectors is limited.

Additionally within the prior art are kits having flexible tubular connectors with pre-formed openings therein. The preformed openings again limit the user as to the number and angular disposition of the interconnected struts. Such tubular connectors are seen in the U.S. Patent to Bombaci, U.S. Pat. No. 3,432,960 and the French patent to Majoux, No. 832,726.

These connectors all require costly forming dies or other costly equipment for their manufacture, resulting in considerable production costs.

Also within the prior art is a construction kit using wooden struts and flexible ring-shaped connectors which the user pierces with a pin, permitting some flexibility as to the number of struts admissible at a given vertex and their relative angles. This method is seen in the U.S. patent to Seubert, U.S. Pat. No. 3,805,441.

My design offers the advantages claimed for Seubert's including reusability of parts and an extremely low cost of production. It is an improvement of Seubert's in at least the following respects: 1. His does not permit widely varying angles in more than one plane without deforming the vertex, and some combinations of angles are not possible at all. All angles are equally acceptable in my invention. 2. Seubert's invention requires the builder to decide in advance the number of struts he or she wants to attach to a given point and to roughly predict their orientation. The structure, in other words, must be designed in whole or in part before construction can begin. My design permits the builder to add on new parts and to alter the angles to suit the evolving model. 3. Collapsing and telescoping models, possible with my design, can not be built with his. 4. The joints in Seubert's invention tend to come undone under stress, whereas the connections in my invention can easily be made as strong as the struts.

In the design patented by Bernstein, U.S. Pat. No. 3,927,489, involving struts joined to connector rings by deformable hooks, structures are deformed from their regular geometrical shapes by the tendency of the connector rings to alter their orientation with respect to the struts. Furthermore, an orientation of the rings proper to a sub-structure may not be acceptable for a larger structure. Thus, for example, Bernstein's design can construct a regular cube, but can not construct two or more linked adjacent cubes.

SUMMARY OF THE INVENTION

The invention is embodied in a construction kit consisting of rigid strut members which may be connected together by tendons at flexible joints. The design allows for unlimited flexibility as to the number of struts admissible at each vertex, and their relative angles. In the preferred embodiment of the invention the struts are made of a rigid hollow tubular material, and the kit includes additional members, herein called extensors, which can be inserted into the struts telescope-fashion, providing additional flexibility as to length of the rigid members of the construction. Accordingly, an almost unlimited variety of geometric and geodesic structures and designs may be easily assembled; and such constructions may be made with stable or flexible angles, and rigid or telescoping sides.

Each strut member is perforated at each end to permit the tendon to be threaded into the strut-end and out again through the same hole. The exiting end of the tendon is then threaded through a second strut-end in the same manner. Pulling the end of the tendon through the newly added strut forces the two strut-ends tightly together. The process is then repeated until the desired number of struts has been connected. Tying the tendon off around each of the struts provides a secure joint and assures the even alignment of the strut-ends. Glue or adhesive is not required, and the struts may be reused after the structure has been disassembled.

An important object of the invention is to provide a construction kit which serves educational as well as recreational purposes. The kit can be used to build small scale models demonstrating principles and applications of plane and solid geometry and three dimensional design. A further object is to maintain a low cost of manufacture and use. The strut members can be made of extremely inexpensive material and can be repeatedly reused. No special tools or equipment are necessary.

BRIEF DESCRIPTION OF THE DRAWING

In the accompanying drawing:

FIG. 3 indicates the manner in which struts are secured to a vertex to assure regular disposition of the strut-ends, where more than three struts have been joined to a single vertex.

FIG. 4 shows the manner in which a square can be stabilized, by attaching struts end-to-side, rather than end-to-end.

DESCRIPTION OF THE PREFERRED EMBODIMENTS

Figure 1:
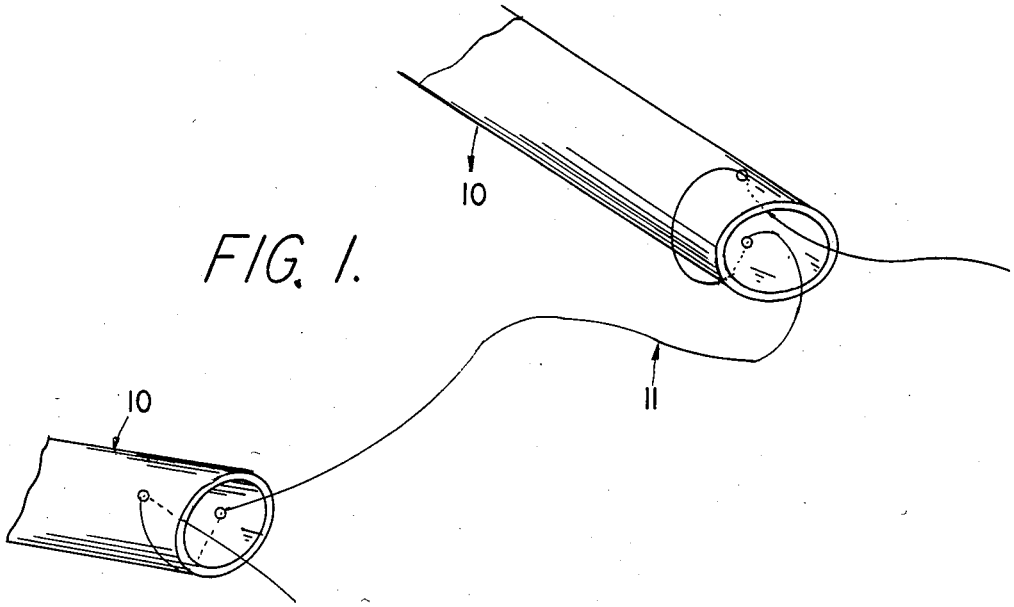
FIG. 1 is a view of two tubular struts showing the configuration of the holes cut in the sides, and the manner in which struts are connected together.

Continued reference is made to the above drawing, reference numerals given here indicating parts similarly identified in the drawing. The measurements given here are for purposes of illustration only.

1. Parts. The kit in its preferred embodiment consists of three parts: (a) The struts: The elongate strut members are most simply and cheaply made of thin plastic straws or "stirrers", measuring $\frac{1}{8}$" in diameter by $5\frac{1}{4}$" in length. Two facing holes, measuring 1/16" in diameter, are cut $\frac{5}{8}$" from each end. The struts are indicated as 10 in FIGS, 1, 2, and 3 of the drawing. (b) The extensors: Plastic straws as desribed in (a) and of the same length, but a different color and with an outside diameter marginally smaller than the inside diameter of the struts, permitting them to slide telescope-fashion into the struts. These are also pierced with two facing holes at each end. The extensors are indicated as 12 in FIG. 2. (3) The tendons: Lengths of monofiliment nylon fishing line, 8 lbs. test being sufficiently strong 16"–18"being a convenient length. The tendons are 11 in FIGS. 1 and 3. Typically, a kit would contain 500 struts, 100 extensors, and a 100 yd. spool of nylon line, along with instructions and suggested projects.

Straws appear to have the conclusive advantages over metal tubing of low cost, and the capability of being easily cut.

Figure 5:
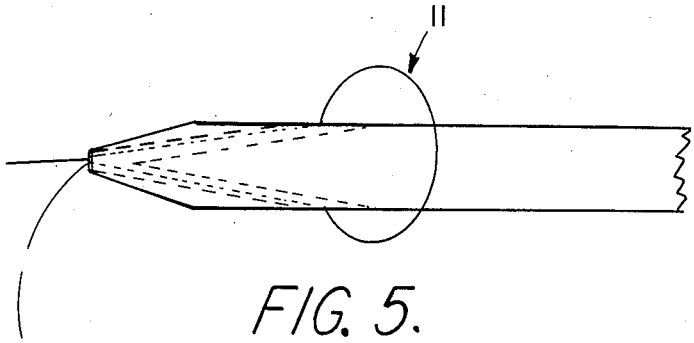
FIG. 5 is a side view showing a strut-end used in one variant of the kit, made of solid material through which two diagonal holes have been cut to receive the tendons, and a tendon passing through the holes.
Figure 6:
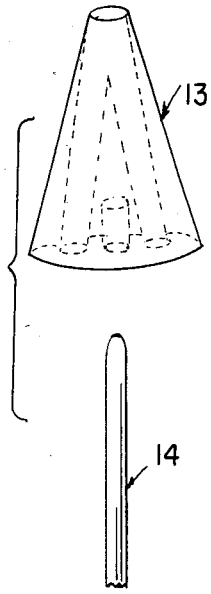
FIG. 6 is a view of a detachable end-piece used in another variant of the kit, and a strut to which the end-piece attaches.

Alternative designs offer some advantages. A more elegant building kit can be made using wooden dowel sticks, tapered at each end almost to a point. Two diagonal holes are drilled in each end, entering through the tapered endpoint and exiting 1" or $1\frac{1}{2}$" down the length of the dowel at opposite points along its circumference. The tendons are threaded into one of the two diagonal holes and out the other. FIG. 5. Alternatively, the kit could be built with detachable conical end-pieces, made of wood or plastic, each with two holes running at diverging diagonals from the vertex to the base. A third hole, drilled vertically from the center of the base, part way up the end-piece, would be designed to fit securely over the end of a strut, which could be made of wood, plastic, or tensile steel wire. FIG. 6. Both of these alternative designs allow for a more exact joining of strut-ends, resulting in somewhat neater models. Both, however, have the disadvantages of greatly increased difficulty of manufacture and cost. Furthermore, it would not be possible to build telescoping figures, or as easy to construct longer or shorter rigid strut lengths.

Figure 2:
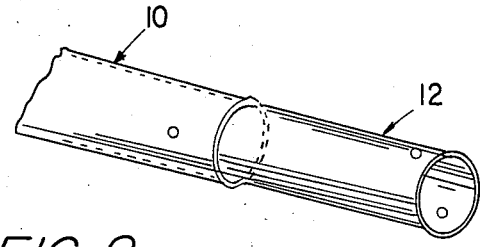
FIG. 2 shows an extensor member inserted into a strut member to make a telescoping compound strut.

2. Method of Construction. Assuming a kit made of plastic tubular struts, extensors, and monofiliment nylon line as described above, the basic method of construction involves the following steps: (a) The line is cut into 16"–18" tendons, this being easily accomplished by wrapping it the desired number of times around an 8"–9" width of cardboard (a slit may be cut in one side of the cardboard and each loop slipped into it) and then cutting all the loops with a scissors. (b) An end of a tendon is then threaded through an end of a strut, through one of the two facing holes, back through the second hole, and out the end again. Both ends of the tendon now protrude through the end of the strut, and these should be adjusted so that one is significantly longer than the other, leaving about 2" for the short end. (c) The long end of the attached tendon is then threaded through a second strut by the same route described in (b) and pulled, forcing the ends of the two struts together at a single vertex. FIG. 1. Any number of additional struts can be added by the same process. (d) When the structure is completed each vertex should be secured by tying together the short and long ends of the tendon in a double knot. If not more than three struts meet at the vertex the strut-ends will align themselves in their proper positions. Of more than three struts are joined at the vertex the knot may leave the strut-ends in an irregular alignment. If so, the long end of the tendon is looped loosely in an overhand knot around one of the struts, and the loop is then pulled over the strut-end and tightened. FIG. 3. This process is then repeated on adjacent struts for each strut joined at the vertex. The loose ends of the tendon can then be cut off with a scissors. (e) Telescoping lengths are made by combining the extensors and the struts. FIG. 2. These longer struts can be made rigid with a pin or a small piece of cellophane tape attached to the end of the strut and the extensor.

3. Additional Options. Two or more struts can be joined together by using the extensors as a sort of internal splint. Tendons can be attached beforehand to the strut-ends which are to be fitted together along the length of this larger compound strut, allowing, for example, the construction of large panar shapes and three dimensional structures built from such larger planes. It is also possible to connect the end of one strut to any point along the length of another. This is done by threading both ends of a tendon through the end of a strut, and through the holes at the end of the strut (forming a loop), and then passing one end of the tendon back through the adjacent hole and out again. A second strut is passed through the loop, which is then tightened by pulling the protruding end of the tendon, and secured with an overhand knot as described in 1(*d*).

Figure 7:
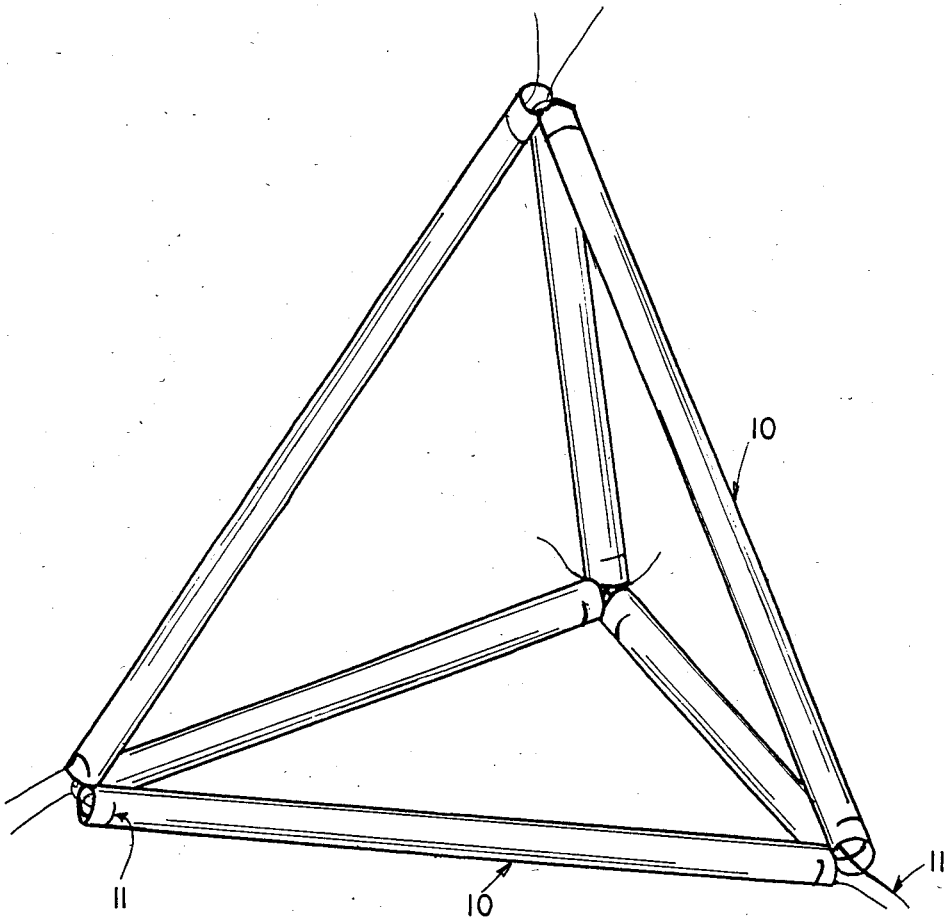
FIG. 7 is a perspective view of a tetrahedron formed in accordance with this invention.

4. Examples of Possible Constructions. The simplest three dimensional structure which can be built with this invention is the tetrahedron, made with four struts. FIG. 7. More tetrahedrons can then be added on to construct rigid columns or space frames. Eight struts can form a pyramid, which flexes at its base, and four more can be added to make a rigid octahedron, again with the possibility of building on more to create space frames and columnar structures. This method works for many polyhedrons. Thus, thirty struts can be joined to build a rigid icosahedron. Some structures will be flexible and can be deformed and folded into a variety of two or three dimensional configurations. Thus, a cube will collapse into a hexagon. An icosahedron with eight key struts removed can be manipulated into a number of interesting and apparently unrelated shapes. (Another means for constructing such a flexible structure is the subject of U.S. Pat. No. 4,274,222 to Zahn and Slovak.) It is also not difficult to construct folding patterns known as flexigons, made with linked triangles or tetrahedrons. An otherwise flexible or folding structure can be made rigid with the use of the extensors. Thus a cube can be braced by diagonals across each of its faces, or across opposite points through its center. Similarly, each pentagonal face of a dodecahedron can be braced with two longer struts. If the extensors are allowed to telescope in and out the model will retain its shape but can be deformed into new shapes. An alternative method of bracing flexible figures is to attach additional struts to each vertex and join the free end of each to the side of an adjacent strut. FIG. 4.

Having described the invention what is desired to be secured under Letters Patent is:

1. A construction toy capable of producing various geometrical structures, comprising a first plurality of elongate strut members, each such strut member being composed of a generally rigid hollow tubular material, said tubular material having a sidewall which forms end openings having an inside diameter and an outside diameter and each such strut member being pierced transversely near each of its ends with two or more distinct openings separate from said end openings, each such opening being adapted to receive a flexible connecting member; and a plurality of flexible connecting members capable of being threaded recursively into a first strut member by passing an end of the flexible connecting member into the hollow end opening of the first strut member, out a first transverse opening, into a second transverse opening, and out the same hollow end opening through which it entered, and thence through the ends of a second and additional strut members in the same manner, and finally knotted so as to secure the joint and align the angular relationships of the struts so joined.

2. A construction toy as claimed in claim 1, further comprising a second plurality of strut members configured identically to said first plurality of strut members, each said strut member having an outside diameter marginally smaller than the inside diameter of said first strut member, and adapted to be inserted into an end thereof, thereby forming a compound strut of variable length.

3. A construction toy capable of producing various geometrical structures, comprising a plurality of elongate strut members, each such strut member being composed of a generally rigid material, each such member being tapered at each of its ends, each end being pierced with two or more passages running generally from the end-point, diagonally to the struts's longitudinal axis, through points along the length of the strut, each such hole being adapted to receive a flexible connecting member; and a plurality of flexible connecting members capable of being threaded recursively into a first strut member by passing an end of the flexible connecting member into the hole at the end of a first strut member, through a first diagonal passage, into and thrugh a second diagonal passage, and out the same end-hole through which it entered, and thence through the ends of a second and additional strut members in the same manner, and finally knotted so as to secure the joint and align the angular relationships of the struts so joined.

4. A construction toy capable of producing a variety of geometrical structures, comprising a plurality of elongate strut members; a plurality of conical end-pieces, each conical end-piece being perforated at its base, vertically thereto, with an opening passage adapted to frictionally receive an end of the strut member, each conical end-piece being additionally pierced with two or more passages running from the vertex of the cone, diagonally to its axis, through its base, each such passage being adapted to receive a flexible connecting member; and a plurality of flexible connecting members capable of being threaded recursively into a first end-piece by passing an end of the flexible connecting member into the hole at the vertex of a first end-piece, through a first diagonal passage, into and through a second diagonal passage, and out the same end-hole through which it entered, and thence through the ends of a second and additional end-pieces in the same manner, and finally knotted so as to secure the joint and align the angular relationships of the end-pieces and struts so joined.

* * * * *